US010573450B2

(12) United States Patent
Davis et al.

(10) Patent No.: US 10,573,450 B2
(45) Date of Patent: Feb. 25, 2020

(54) DEGAUSS CIRCUIT FOR USE IN AN ELECTRONICALLY ACTUATED DOOR LOCK

(71) Applicant: Hanchett Entry Systems, Inc., Phoenix, AZ (US)

(72) Inventors: Brett L. Davis, Gilbert, AZ (US); Randall Shaffer, Phoenix, AZ (US); Eric Anderson, Tempe, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 262 days.

(21) Appl. No.: 15/698,853

(22) Filed: Sep. 8, 2017

(65) Prior Publication Data

US 2018/0075961 A1 Mar. 15, 2018

Related U.S. Application Data

(60) Provisional application No. 62/385,672, filed on Sep. 9, 2016.

(51) Int. Cl.

| | |
|---|---|
| ***H01F 13/00*** | (2006.01) |
| ***E05B 47/00*** | (2006.01) |
| ***E05C 19/16*** | (2006.01) |

(52) U.S. Cl.

CPC ..... *H01F 13/006* (2013.01); *E05B 47/0002* (2013.01); *E05C 19/166* (2013.01); *E05B 2047/0048* (2013.01); *E05B 2047/0068* (2013.01)

(58) Field of Classification Search

CPC ..... H01F 13/006; E05B 47/0002; E05B 2047/0048; E05B 2047/0068; E05C 19/166

USPC ..... 361/149

See application file for complete search history.

(56) References Cited

U.S. PATENT DOCUMENTS

| | | | | |
|---|---|---|---|---|
| 5,376,910 | A * | 12/1994 | Geringer | E05C 19/166 292/251.5 |
| 6,611,414 | B1 * | 8/2003 | Lavelle | E05C 19/168 361/154 |
| 8,094,017 | B2 | 1/2012 | Hunt | |
| 2007/0188967 | A1 * | 8/2007 | Smith | H01F 7/1816 361/155 |
| 2010/0325967 | A1 | 12/2010 | Pearson | |

* cited by examiner

*Primary Examiner* — Kevin J Comber

(74) *Attorney, Agent, or Firm* — Woods Oviatt Gilman LLP; Ronald J. Kisicki, Esq.

(57) ABSTRACT

A novel and useful degauss circuit for use with electromagnetic door locks. The door lock circuit is configured to provide a constant current to the electromagnetic coil load. A pulse width modulation (PWM) controller varies the frequency and/or duty cycle to a switch in series with the coil. Coil current feedback is used to adjust the PWM frequency and/or duty cycle so as to maintain the current through the coil at a certain level to maintain a desired holding force on the door lock. A degauss circuit inline with the current flowing through the coil is provided. When triggered either in an uncontrolled or controlled manner, a series RLC circuit that includes the coil inductance and resistance causes ringing to occur whereby the coil current reverses direction with sufficient amplitude and duration to degauss the coil.

13 Claims, 4 Drawing Sheets

40 5

DEGAUSS CIRCUIT FOR USE IN AN ELECTRONICALLY ACTUATED DOOR LOCK

The present application claims the benefit of U.S. Provisional Patent Application No. 62/385,672, filed Sep. 9, 2016, the content of which is incorporated by reference in its entirety.

TECHNICAL FIELD

The subject matter disclosed herein relates to the field of electromagnetics and more particularly relates to a degauss circuit for an electromagnet such as found in electronically actuated door locks.

BACKGROUND OF THE INVENTION

Electromagnetic locks, also referred to as maglocks, are well known locking devices that consist of an electromagnet and an armature plate. There are two main types of electric locking devices. Locking devices can be either "fail safe" or "fail secure". A fail-secure locking device remains locked when power is lost. Fail-safe locking devices are unlocked when de-energized. Direct pull electromagnetic locks are inherently fail-safe. Typically, the electromagnet portion of the lock is attached to the door frame and a mating armature plate is attached to the door. The two components are in contact when the door is closed. When the electromagnet is energized, a current passing through the electromagnet creates a magnetic flux that causes the armature plate to attract to the electromagnet, creating a locking action. Because the mating area of the electromagnet and armature is relatively large, the force created by the magnetic flux is strong enough to keep the door locked even under stress. Typical single door electromagnetic locks are available with up to 1500 pounds dynamic holding force capabilities.

The magnetic lock relies upon the basic concepts of electromagnetism. Essentially, it consists of an electromagnet attracting a conductor with a force large enough to prevent the door from being opened. More specifically, the device makes use of the fact that a current through one or more loops of wire, i.e. a solenoid, produces a magnetic field. This works in free space, but if the solenoid is wrapped around a ferromagnetic core such as soft iron the effect of the field is greatly amplified. This is because the internal magnetic domains of the material align with each other to greatly enhance the magnetic flux density.

As mentioned, an electromagnetic lock operates under the premise of running an electric current though copper coils that surround a solid or laminate core of some ferrous material. This operation produces a magnetic field that permeates the core, and when the strike plate is introduced to the electromagnet, maximum magnetic holding force is created.

When the current through the coil is removed, the magnetic field collapses, but the core material maintains some amount of residual magnetism that continues to attract the strike plate. In the lock industry, this residual magnetism is not desired. Building code requirements often stipulate that the strike must be able to be separated from the electromagnet with minimal amount of force in a minimum amount of time. This can only be achieved with rapidly neutralizing the magnetic field through a degauss circuit. The process of degaussing removes or neutralizes the magnetic field of an object. Neutralizing a magnetic field almost always infers generating an opposing magnetic field. This is accomplished by reversing the direction of the current flowing through the coil windings.

Accordingly, there is a need for a degauss circuit that is capable of removing or neutralizing the magnetic field of an electromagnetic lock such that building code requirements are met whereby the strike can be separated from the electromagnet within the required time using the mandated amount of force.

SUMMARY OF THE INVENTION

The present invention concerns a degauss circuit for use with electromagnetic door locks. The door lock circuit is configured to provide a constant current to the electromagnetic coil load. A pulse width modulation (PWM) controller varies the frequency and/or duty cycle to a switch in series with the coil. Coil current feedback is used to adjust the PWM frequency and/or duty cycle so as to maintain the current through the coil at a certain level to maintain a desired holding force on the door lock. A degauss circuit in-line with the current flowing through the coil is provided. When triggered either in an uncontrolled or controlled manner, a series RLC circuit that includes the coil inductance and resistance causes ringing to occur whereby the coil current reverses direction with sufficient amplitude and duration to degauss the coil.

BRIEF DESCRIPTION OF THE DRAWINGS

The invention is herein described, by way of example only, with reference to the accompanying drawings, wherein.

DETAILED DESCRIPTION

Figure 1:
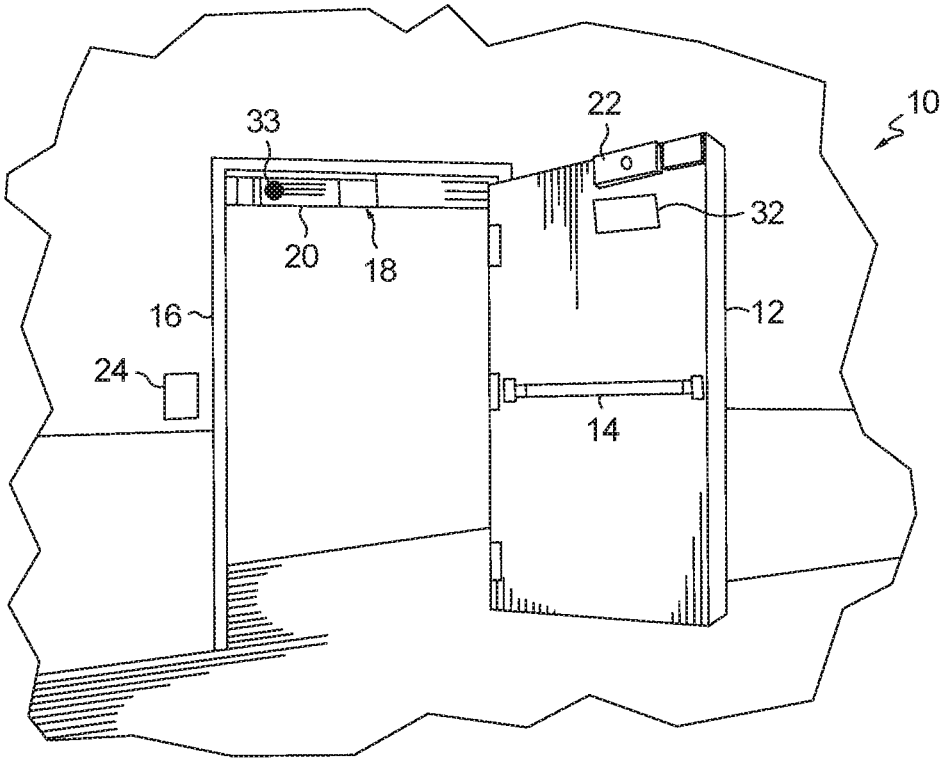
FIG. 1 is a diagram illustrating an example electromagnetic door lock installation incorporating the degaussing circuit of the present invention.

In the following detailed description, numerous specific details are set forth in order to provide a thorough understanding of the invention. It will be understood by those skilled in the art, however, that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary, for the understanding and appreciation of the underlying concepts of the present invention and in order not to obfuscate or distract from the teachings of the present invention.

Any reference in the specification to a method should be applied mutatis mutandis to a system capable of executing the method. Any reference in the specification to a system should be applied mutatis mutandis to a method that may be executed by the system.

Definitions

The following definitions apply throughout this document.

The term "unauthorized attempt to open the door" shall mean a forceful attempt to open the door to gain unauthorized entry to an area secured by the door.

The term "naturally occurring external forces" shall mean forces that may be applied to the door (e.g., wind forces or vibration) that may move the door from its closed position other than forces attributed to an unauthorized attempt to open the door.

The term "closed door" position is intended to mean a position of the door when it is generally engaged with the door frame or when the armature of the electromagnet lock is engaged with the electromagnet.

Electromagnetic Door Lock

A diagram illustrating an example electromagnetic door lock installation incorporating the degaussing circuit of the present invention is shown in FIG. 1. An electromagnetic door locking system, generally referenced 10, is shown mounted to door frame 16. The locking system comprises electromagnet assembly 18 including electromagnet 20. Door 12 is provided with an armature 22 for electromagnetically locking to electromagnet 20. In a secured setting, an authentication device 24, e.g., keypad, swipe card reader, key fob reader or biometric sensor, may be provided whereby the electromagnet 20 de-energizes only upon input of proper access credentials at the authentication device, thereby releasing armature 22 from electromagnet 20.

The door 12 may optionally be equipped with a mechanical door release mechanism 14, such as a push bar, that operates a latch (not shown), the latch engaging a corresponding recess in door frame 16. Note that alternatively, the latch could also be operated by a door knob or door lever. To open door 12 using door release mechanism 14, a person pushes on door release mechanism 14 which causes the latch to be released from the recess in the door frame, and thereby allow pushing of the door outwardly only if the electromagnet is de-energized as described above.

Figure 2:
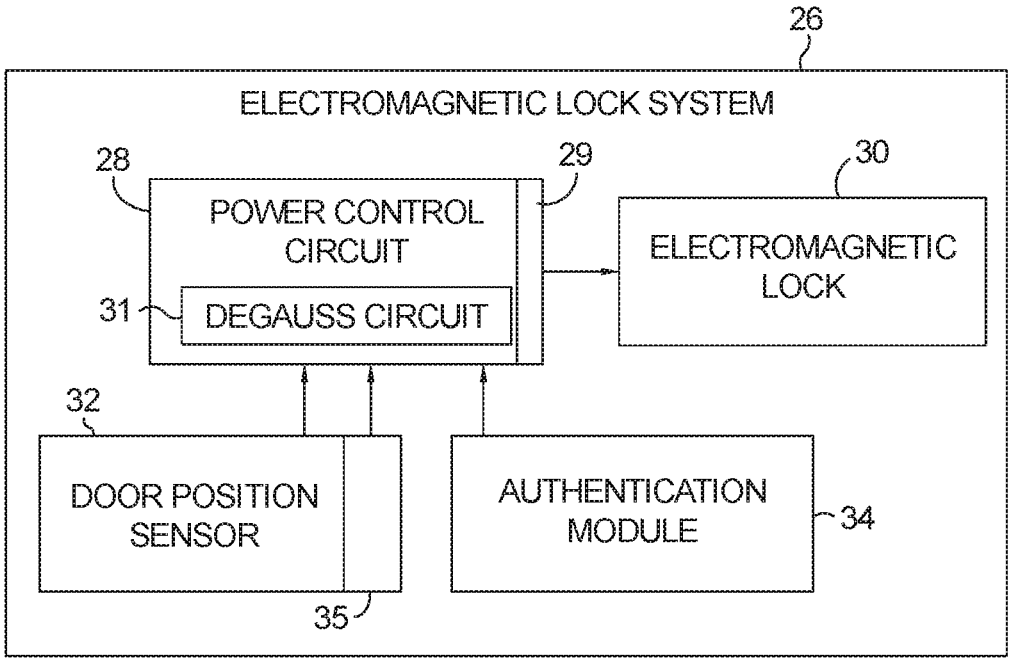
FIG. 2 is a block diagram illustrating an example electromagnetic lock system incorporating the degaussing circuit of the present invention.

A block diagram illustrating an example electromagnetic lock system incorporating the degaussing circuit of the present invention is shown in FIG. 2. The electromagnetic door locking system, generally referenced 26, comprises a power control circuit 28 including a microprocessor 29 and a degauss circuit 31, an electromagnetic lock 30 (such as electromagnet 20 and armature 22, FIG. 1), a door position sensor 32 installed on the door side or alternatively door position sensor 33 installed on the door frame side, and an authentication module 34 (such as authentication device 24, FIG. 1).

Door position sensor 32, 33 may incorporate any suitable sensor system capable of sensing when the door is closed and not closed. Example sensor types include a photo sensor, a pressure sensor, a micro switch, a passive infrared sensor, a radio frequency (RF) sensor or a reed switch, or the like. A "closed door" position is understood to mean a position of the door when it is generally engaged with the door frame or when the armature of the electromagnet lock is engaged with the electromagnet. Therefore, door position sensor 32, 33 may also be a magnetic bond sensor that monitors when an electromagnetic lock armature is seated against the electromagnet, of the type disclosed in U.S. Pat. No. 8,094,017, incorporated herein by reference in its entirety.

Door position sensor 32. 33, may also comprise a magnetic bond sensor that senses a change in the magnetic field as the armature separates from the electromagnet as disclosed in U.S. Patent Publication No. 2010/0325967, incorporated herein by reference in its entirety.

Note that one or more secondary door position sensors 35 may be included to work as redundant door position sensors should primary door position sensor 32, 33 fail to perform as intended. For example, circuitry may be provided so that, if a secondary back-up sensor senses the door to be closed while the primary sensor 32, 33 does not, an alert signal may be sent back to power control circuit 28, and an alarm signal may be triggered to notify of a malfunctioning primary door position sensor 32, 33. A similar alarm signal may be triggered if primary sensor 32, 33 senses a door closed status and the secondary back-up door position sensor does not.

Electromagnetic lock 30 is electrically coupled to power control circuit 28 and is configured to receive electric power from power control circuit 28 so as to energize electromagnet 20 and secure door 12 within frame 16 via the electromagnetic attraction between electromagnet 20 and armature 22. In one embodiment, when door position sensor 32, 33 senses that the door is not closed, electrical power may be cut off or reduced to electromagnet 20.

Constant Current Driven Electromagnet

The door lock system disclosed herein comprises a constant current controller that supplies a constant current to an inductive load as disclosed in U.S. patent application Ser. No. 15/098,522 which is hereby incorporated in its entirety by reference. The inductive load comprises an inductance (L) and series resistance (R). The controller comprises a switching circuit incorporating a primary switch and a secondary switch. During a time interval in which the primary switch is closed ($t_{on}$), the secondary switch is open and the voltage across the inductive load is equal to the source voltage ($V_s$). At time $t_{on}$ until the end of a time period (T), with the primary switch open and the secondary switch closed, zero volts appears across the inductive load. During this interval, load current continues to flow due to the stored energy in the inductance. The periodic current in the inductive load is dependent upon the stored energy, the parameters of the control circuit, and the duration of $t_{on}$.

In one embodiment, the controller further operates as a pulse width modulation (PWM) controller that causes the periodic current in the inductive load to become constant by implementing a sufficiently large switching frequency. As the frequency increases, the boundary current and the peak current approach the same constant value. In one embodiment of the controller, the inductive load may comprise a solenoid, DC motor, or a magnetic actuator. In one embodiment of the controller, the primary switch comprises a MOSFET and the secondary switch may comprise a free-wheeling diode. In one embodiment, the inductive load may be used to lock and unlock an electromechanical door latch or electromechanical strike.

In one embodiment of the controller, the switching circuit may comprise a current transformer, bridge rectifier, burden resistor, and low-pass filter. In this embodiment, the current transformer has two single-turn primary windings and one secondary winding. The first primary winding is connected in series with the primary switch. The second primary winding is connected in series with the secondary switch and the primary windings are used for sensing the current of the inductive load. The secondary winding has N-turns and is directly connected to the AC input of the bridge rectifier. The burden resistor is connected directly across the DC output of the bridge rectifier. The burden resistor is directly connected to the low-pass filter.

In another embodiment, the switching circuit may comprise a current transformer, bridge rectifier, burden resistor, low-pass filter, and a timer integrated circuit (TIC). In this embodiment, the current transformer has two single-turn primary windings and one secondary winding. The first primary winding is connected in series with the primary switch and the second primary winding is connected in series with the secondary switch. The primary windings are used for sensing the current of the inductive load. The secondary winding has N-turns and is directly connected to the AC input of the bridge rectifier. The burden resistor is directly connected to the DC output of the bridge rectifier. The burden resistor is directly connected to the low-pass filter. The TIC establishes the time interval of the periodic current in the inductive load. To function in this manner, the TIC receives a signal through an input that initiates this time interval.

In another embodiment, the switching circuit may comprise a current-sensing circuit and a PWM controller. The primary switch comprises a transistor, e.g., a MOSFET, and the secondary switch comprises a diode or MOSFET. The current sensing circuit may be a current-sense resistor with an amplifier, a current-sensing integrated circuit, a Hall-effect current sensor, or any other appropriate current sensing circuit known in the art. The current-sensing circuit feeds a voltage proportional to load current to the PWM controller which correspondingly adjusts the duty ratio to achieve the desired load current.

In another exemplary circuit implementation of the constant-current controller, the PWM controller controls the duty ratio of the primary switch. The PWM controller may be a software-programmable device such as a microprocessor or a firmware programmable device such as a microcontroller or FPGA. The PWM controller may also contain the necessary circuitry to drive the primary switch. The primary switch may be a MOSFET or other appropriate switching device. A secondary switch may be a diode or other appropriate switching device. A current-sensing circuit provides a voltage proportional to load current to the PWM controller which adjusts the duty ratio to achieve the desired load current. The current-sensing circuit may be a current-sense resistor, a current-sense amplifier, a Hall-effect sensor, or other suitable current sensing circuit.

In this embodiment, the current-sensing circuit measures the current through the inductive load when the primary switch is on and the secondary switch is off. When the primary switch is off, current continues to flow through the secondary switch during which the time current-sensing circuit continues to measure the current of the inductive load.

In another exemplary circuit implementation of the constant-current controller, the PWM controller controls the frequency and/or the duty ratios of the primary switch and secondary switch. The PWM controller may be a software programmable device such as a microprocessor or a firmware programmable device such as a microcontroller or FPGA. The PWM controller may also contain the necessary circuitry to drive the primary switch and secondary switch. The primary switch may be a MOSFET or other appropriate switching device; the secondary switch may also be a MOSFET or other appropriate switching device. The current-sensing circuit provides a voltage proportional to load current to the PWM controller which adjusts the PWM frequency and/or duty ratio to achieve the desired load current. The current-sensing circuit may be a current-sense resistor, a current-sense amplifier, a Hall-effect sensor, or other suitable current sensing circuit.

In this embodiment, the current-sensing circuit measures the current of the inductive load when the primary switch is on and the secondary switch is off. When the primary switch is off, the secondary switch is on and current continues to flow through the inductive load and the current-sensing circuit. When the secondary switch is on and the primary switch is off, the current-sensing circuit continues to measure the current of the inductive load. The PWM controller generates the appropriate signals to synchronously alternate the on-times and off-times of the primary and secondary switches, respectively.

Degauss Circuit Operation

The electromagnetic lock operates by passing current though coils that surround a ferrous core. This generates a magnetic field that permeates the core creating a magnetic holding force. When the current is removed the magnetic field collapses but the core material maintains some residual magnetism that continues to attract the strike plate. This residual magnetism must be neutralized using a degauss circuit which generates an opposing magnetic field by reversing the direction of the current flowing through the coil.

In one exemplary embodiment known in the art, degaussing is accomplished using double pole double throw (DPDT) relay. When the relay is in a normally closed (NC) state, current flows through the windings in one direction and when activated, the current flows through the normally open (NO) contact state. The timing of when to trip the relay and for how long, however, is critical in that if current flows in the opposite direction for too long then a magnetic field will be generated in the opposite direction leaving yet another residual field to neutralize.

In a second exemplary embodiment known in the art, degaussing is achieved by generating an opposing field such that when power is removed from the electromagnet, an underdamped current response (ringing) is introduced via a capacitive/resistive circuit. As the ringing dissipates, it has induced the required opposing current to negate the magnetic field. This method, however, requires tuning of the capacitive/resistive circuit in relation to the inductive characteristics of the electromagnet.

In the first and second exemplary embodiments described supra, a key aspect is the use of a constant applied voltage while the electromagnet is engaged. In the second embodiment, the capacitor in the circuit is charged to the applied voltage when engaged, acting like a battery. When the applied voltage is removed, the capacitor discharges its stored energy in an opposing direction thereby inducing the ringing which causes the magnetic field to collapse.

Figure 3:
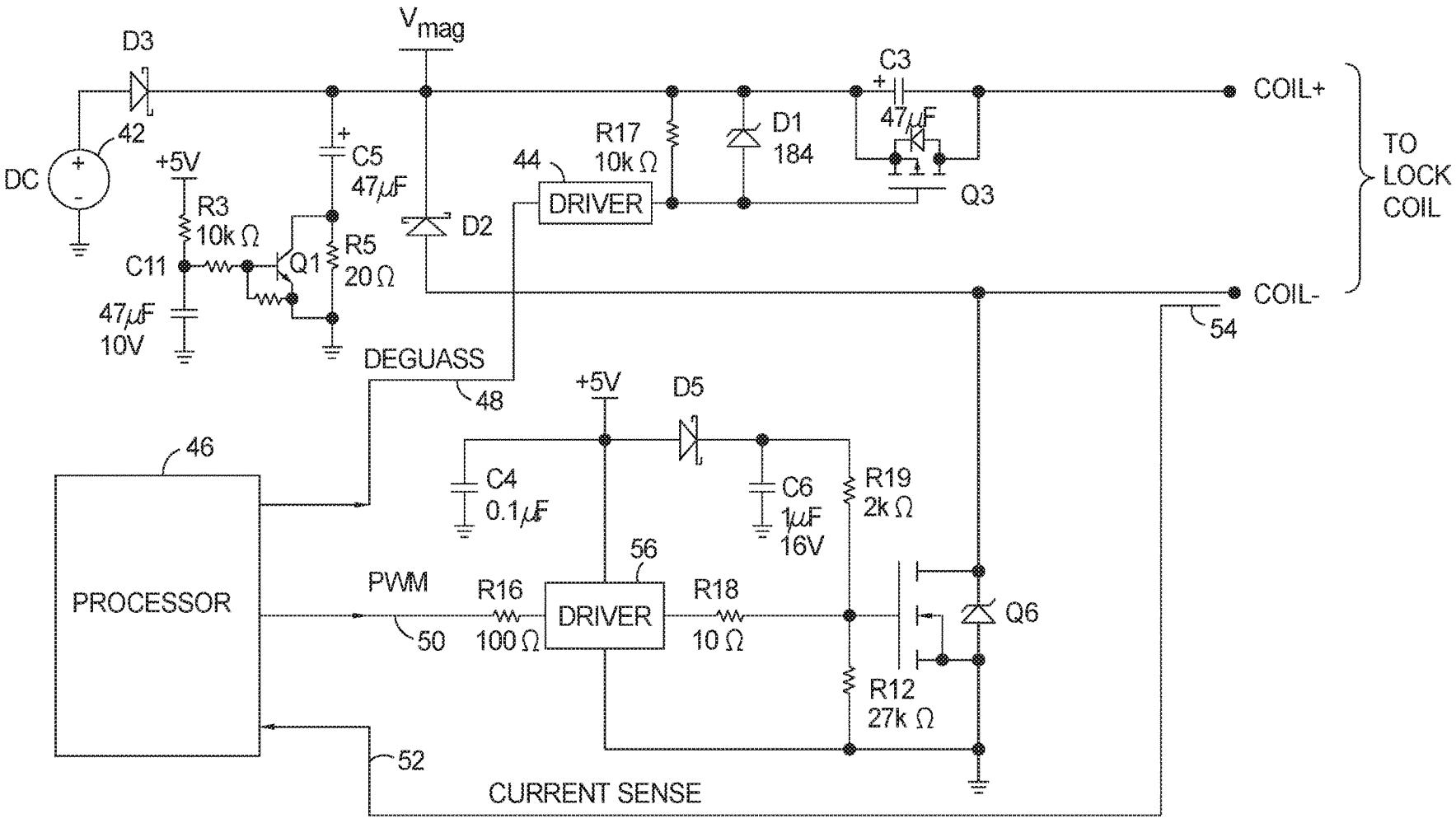
FIG. 3 is a schematic diagram illustrating an example degauss circuit suitable for use with an electromagnetic lock system.

A schematic diagram illustrating an example degauss circuit suitable for use with an electromagnetic lock system in accordance with the invention is shown in FIG. 3. The degauss circuit, generally referenced 40, comprises DC source 42, Schottky diodes D2, D3, D5, Zener diode D1, transistors Q1, Q3, Q6, capacitors C3, C4, C5, C6, C11, resisters R3, R12, R16, R17, R18, R19, driver circuits 44, 56, and processor 46.

Under normal operation, such as when a door lock is secure and the electromagnet is energized, the DC supply 42 provides current that flows through p-channel FET Q3, the coil and n-channel FET Q6. A constant current is maintained through the coil by applying a pulse width modulated (PWM) signal 50 generated by the processor 46 to driver 56 through R16. The output of the driver is coupled to the gate of Q6 via R18. The current flowing through the coil is sensed via current sense circuit 54 and input to the processor. The processor implements a software feedback loop and generates the PWM signal at an appropriate frequency and/or duty cycle to maintain a desired current flow through the coil resulting in a steady holding force by the door lock on the door.

In one embodiment, the nominal frequency of the PWM signal is approximately 23 kHz. Note that the processor 46 may be a software-programmable device such as a personal computer, hand-held or laptop devices, multiprocessor systems, microprocessor, microcontroller or microcomputer based system, programmable consumer electronics, ASIC or FPGA core, DSP core, minicomputer, distributed computing environments that include any of the above systems or devices, and the like.

Therefore, a constant current flow through the coil when the electromagnet is energized is accomplished by turning the gating transistor Q6 on and off via the PWM signal 50. When Q6 is on, the current flows through D3, Q3, the coil and Q6. When Q6 is off, current flows from C3 through the coil and returns via D2. It is noted that the PWM signal controls the state of transistor Q6. It is also noted that the degauss signal 48 is held in a low state (sinking current from the gate of Q3) when the degauss circuit is not active which turns p-channel FET Q3 on, effectively shorting capacitor C3, thereby removing it from the current path.

Thus, the operation of the electromagnetic lock is not dependent on a fixed applied voltage (e.g., the industry standard of 12V or 24V). The circuit 40 is able to operate across all voltage ranges, allowing it to maintain a constant current regardless of supplied voltage level. In one embodiment, the degauss circuit uses this constant current feature to its advantage.

In a door secure mode, the capacitor C3 is bypassed via switch Q3 and holding force current flows through switch Q3 to the coil. During the degaussing operation, the switch Q3 turns on (i.e. closes) and capacitor C3 is placed in the circuit (i.e. in series with the coil inductance).

The degauss circuit 40 also comprises an inrush circuit comprising R3, R5, C5, C11, and Q1. In operation, at circuit startup before the five-volt supply is established, capacitor C5 charges to the DC supply level minus the voltage drop across D3. Once the five-volt supply is established, Q1 turns on and shorts out resistor R5.

In one embodiment, the degauss circuit is activated every time the door is opened. This is to minimize the residual magnetism retained by the electromagnetic coil. The degauss circuit can be activated in either one of two modes. The first is an uncontrolled degauss and the second is a controlled degauss. Each will be described in more detail infra.

It is noted that the capacitor C3 that provides the degauss ringing in combination with the coil inductance, is in series (i.e. in-line) with the current that flows through the coil. In addition, it is noted that Q3 and Q6 play a dual role in the circuit 40 since they (1) function in energizing the coil to provide secure holding force; and (2) function in degaussing the coil in either uncontrolled or controlled operation modes.

An uncontrolled degauss occurs when the main source power is removed from the circuit for whatever reason, e.g., power is suddenly cut, utility power failure or blackout, backup power system failure, malicious sabotage, etc. The uncontrolled degauss is the typical scenario used when an access control system (ACS) coupled to the degauss circuit 40 removes power to allow access through a normally secure door. An intelligent system would have no warning of this event, therefore immediate activation of the degauss circuit is required.

A controlled degauss can occur when an intelligent system has secondary functions that allow it to release the door without involving the access control system. In this case, the main source power remains on but access is still granted.

Uncontrolled Degaussing

In an uncontrolled degauss, such as when power is abruptly removed from the lock, the DC supply 42 is removed along with the degauss signal 48 and PWM signal 50. The gate of Q3 is pulled high via charge from C5 through R17 which causes Q3 to turn off thereby removing the short across capacitor C3 and placing C3/C5 in series with the coil inductance. It is the resonance of this series LC that provides the ringing that is used to degauss the coil.

In addition, the PWM signal 50 is removed which removes the output from driver 56. The charge on capacitor C6, charged through D5 via the five-volt supply, is applied to the gate of Q6 via voltage divider R19/R12 to maintain n-channel FET Q6 in the on state thereby grounding the coil and D2.

Figure 4:
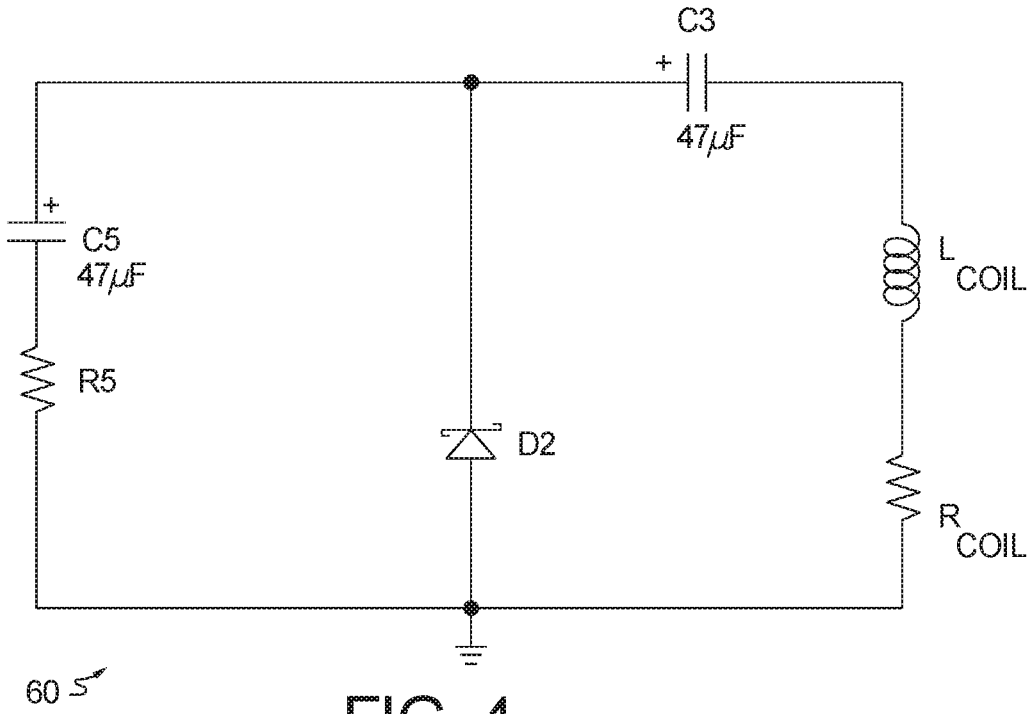
FIG. 4 is a schematic diagram illustrating an equivalent circuit when degaussing of the electromagnet coils is active.

A schematic diagram illustrating an equivalent circuit when degaussing of the electromagnet coils is active is shown in FIG. 4. When the DC source in circuit 40 is removed, the equivalent circuit, generally referenced 60, comprises C5, C3, D2, R5, $R_{COIL}$, and $L_{COIL}$. With the DC source 42 removed, the PWM driving Q6 is removed and Q6 is left in its on state. Degaussing is initiated with Q3 turned off thus placing capacitor C3 in the circuit. The RLC combination of $R_{COIL}$, $L_{COIL}$, and C3/C5 resonate (i.e. ring, oscillate, etc.) causing current to reverse direction through the coil thereby providing degaussing. Using this equivalent circuit, when degaussing is required, a ringing or oscillation occurs which provides the needed energy to reverse the current in the coil.

Note that Q1, normally kept on via current from the five-volt supply through R3, turns off once the five-volt supply is removed. This action may or may not be simultaneous with the removal of the DC supply 42. When Q1 turns off, 20 Ohm resistor R5 is placed in the circuit in series with capacitor C5.

Using the equation $$R = 2\sqrt{\frac{L}{C}} \tag{1}$$

as a guideline, R=R5+$R_{COIL}$, C=C3, the damping of the ringing can be tuned to ensure sufficient current reversal to suppress the magnetic field in the lock.

Controlled Degaussing

In a controlled degauss, the processor sets the degauss signal 48 applied to the gate of Q3 to a high level via driver 44. The gate of Q3 is thus pulled high which causes Q3 to turn off thereby removing the short across capacitor C3 and placing C3/C5 in series with the coil inductance as in the uncontrolled degauss operation described supra. The DC supply 42 is not removed but the processor sets the PWM signal 50 high leaving Q6 in the on state thereby grounding the coil and D2. As before, it is the resonance of the series LC that provides the ringing that is used to degauss the coil.

The schematic diagram illustrating an equivalent circuit when degaussing of the electromagnet coils is active shown in FIG. 4 is applicable in the controlled degauss case with the exception of 20 Ohm resistor R5 which is normally shorted via Q1 remaining on. Q1 remains on since the five-volt supply remains which is connected to the base of Q1 via R3. Thus, when a controlled degauss operation occurs, the equivalent circuit comprises C5 coupled to ground, C3, D2, $R_{COIL}$, and $L_{COIL}$. Degaussing occurs with Q3 turned off thus placing capacitor C3 in the circuit. The LC combination of C3/C5 and $L_{COIL}$ resonate (i.e. ring, oscillate, etc.) causing current to reverse direction through the coil thereby providing degaussing. With this equivalent circuit, when degaussing is required, a ringing or oscillation occurs which provides the needed energy to reverse the current in the coil.

Degauss Waveforms

Figure 5:
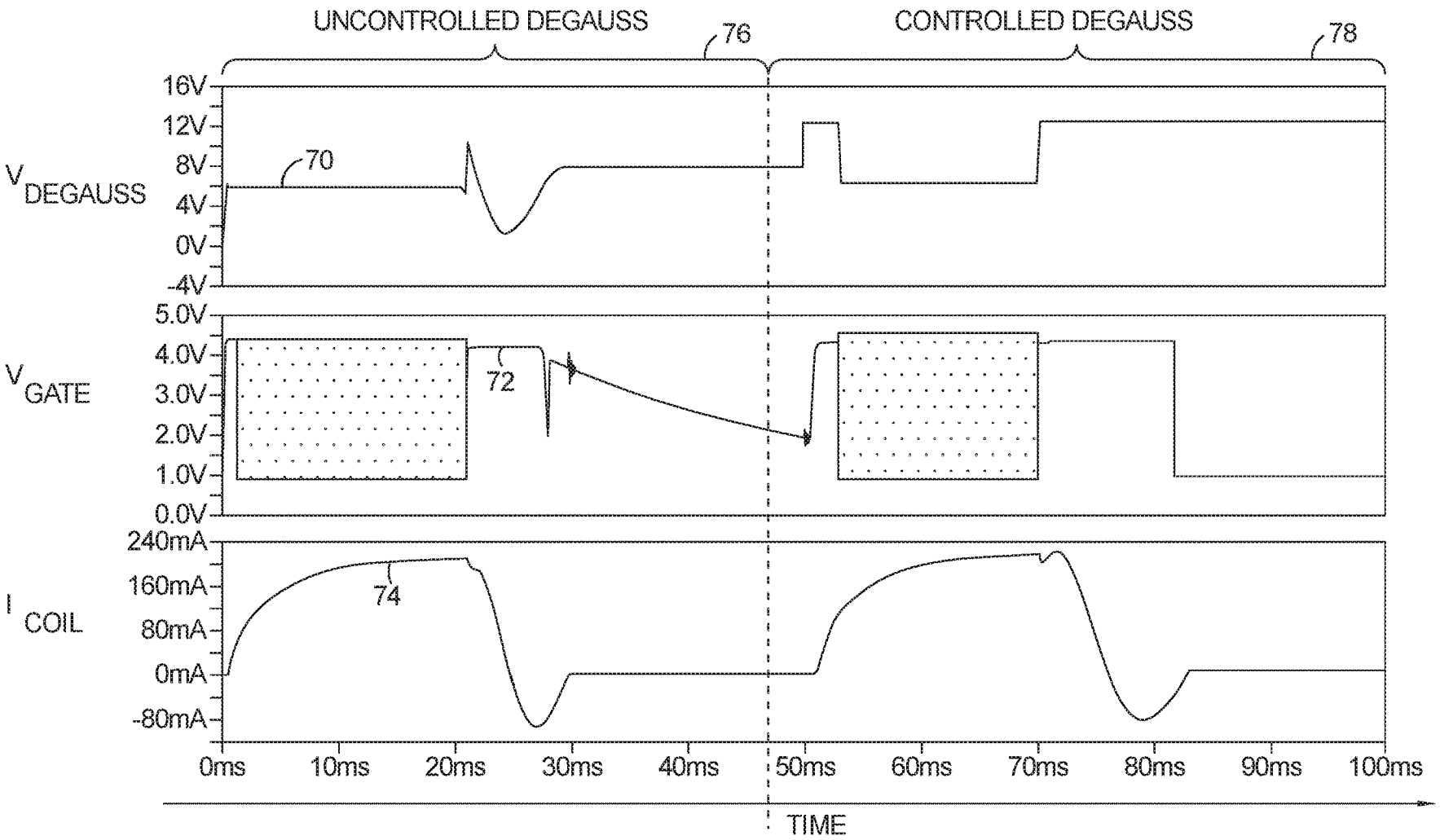
FIG. 5 is a diagram illustrating the waveforms for the degauss signal, Q6 gate voltage and the current through the electromagnet coil during both uncontrolled and controlled degauss operations.

A diagram illustrating the waveforms for the degauss signal, Q6 gate voltage and the current through the electromagnet coil during both uncontrolled and controlled degauss operations is shown in FIG. 5. The waveforms shown in FIG. 5 are results of simulations and depict what transpires during the degaussing of the electromagnet. A first portion 76 shows the waveforms during an uncontrolled degauss and a second portion 78 shows the waveforms during a controlled degauss. It is noted that the time scale represented in the waveforms are with regard to simulation parameters and are set to aid the simulation and should not be construed as absolute representations of the operation of the degauss described. It is appreciated that alternative values will provide similar results with different timings.

With reference to the waveforms during an uncontrolled degauss 76, at approximately 20 ms the power is removed from the circuit 40. Although the degauss signal 70 is undefined, Q3 is turns off via charge stored on capacitor C5 through resistor R17. This initiates the ringing sequence. The Q6 gate voltage 72 is held high via the combination of C6, R19, and R12. Transistor Q6 is kept on long enough after losing the PWM signal 50 to allow the ringing to transition to a reverse current and return to zero current (coil current waveform 74), effectively degaussing the electromagnet (i.e. the horizontal line indicating zero current through the coil beginning at approximately 30 ms).

With reference to the waveforms during a controlled degauss 78, at approximately 70 ms the degauss signal 70 is set active (i.e. high) which turns Q3 off. This initiates the ringing sequence. The Q6 gate voltage 72 is held high either via the PWM signal 50 set high by the processor or via the combination of C6, R19, and R12. In either case, transistor Q6 is kept on long enough to allow the ringing to transition to a reverse current and return to zero current (coil current waveform 74), effectively degaussing the electromagnet (i.e. the horizontal line indicating zero current through the coil beginning at approximately 83 ms).

Those skilled in the art will recognize that the boundaries between logic and circuit blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediary components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In the claims, any reference signs placed between parentheses shall not be construed as limiting the claim. The use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first," "second," etc. are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. In an electromagnet, wherein said electromagnet includes a ferromagnetic core and a coil wrapped around said core, a method of degaussing said core, the method comprising:

providing a DC power supply configured to power said coil;

providing a pulse width modulated (PWM) controller connected to said DC power supply and configured to maintain a first constant current flow through said coil, wherein said first constant current flows through said coil in a first direction; and providing a capacitor and a circuit resistance in-line with said current flow through said coil;

wherein during a degauss operation of said core, controllably switching said capacitor in series with said coil to form a series RLC, whereby said controllably switching of said capacitor in series with said coil and said circuit resistance causes a second current to flow through said coil in a second direction opposite said first direction with a sufficient amplitude and a damped duration to effectively degauss said core; and bypassing said capacitor other than during said degauss operation.

2. The method of degaussing said core of said electromagnet in accordance with claim 1 wherein said controllably switching step is provided by a transistor.

3. The method of degaussing said core of said electromagnet in accordance with claim 2 wherein said transistor is an n-channel Field-Effect Transistor (FET).

4. The method of degaussing said core of said electromagnet in accordance with claim 2 comprising the further steps of:

providing an electronically activated door lock wherein said electromagnet is configured to operate said electronically activated door lock, and causing said transistor to switch said capacitor in series with said coil to cause a controlled degaussing operation to occur.

5. The method of degaussing said core of said electromagnet in accordance with claim 4 wherein said electronically activated door lock is a maglock.

6. The method of degaussing said core of said electromagnet in accordance with claim 1 comprising the further steps of:

providing an electromagnetic lock wherein said electromagnet is configured to operate said electromagnetic lock, and removing said DC power supply to cause an uncontrolled degaussing operation to occur.

7. The method of degaussing said core of said electromagnet in accordance with claim 1 comprising further step of:

selecting a size of said capacitor to ensure a sufficient current amplitude and duration in said second current flow direction to effect degaussing of said core.

8. The method of degaussing said core of said electromagnet in accordance with claim 1 wherein said circuit resistance includes a resistor in series with said capacitor and said coil to form said series RLC.

9. A system for degaussing a ferrous material core of an electromagnet, wherein said electromagnet includes a coil wrapped around said core, said system comprising:

a pulse width modulated (PWM) controller configured to provide a constant current flow through said electromagnetic coil in a first direction;

a capacitor operatively disposed in-line with said current flow; and a switching device configured to cause a second current to flow in a second direction opposite said first direction with a sufficient amplitude and a damped duration to effectively degauss said core, wherein, by selectively switching said switching device, said capacitor may be selectively bypassed when said core is not degaussed.

10. The system for degaussing said core in accordance with claim 9 wherein said switching device is an n-channel Field-Effect Transistor (FET).

11. The system for degaussing said core in accordance with claim 9 wherein a signal generated by said PWM controller is approximately 23 kHz.

12. The system for degaussing said core in accordance with claim 9 wherein said electromagnet is configured to operate an electronically activated door lock, wherein said electronically activated door lock includes an armature, and wherein when said coil is energized, current passing through said electromagnet creates a magnetic flux that causes the armature to attract to said electromagnet.

13. The system for degaussing said core in accordance with claim 12 wherein said electronically activated door lock is a maglock and said armature is an armature plate.

* * * * *